US007194994B1

(12) United States Patent
Chisenhall et al.

(10) Patent No.: US 7,194,994 B1
(45) Date of Patent: Mar. 27, 2007

(54) BRACKET ASSEMBLY FOR MOUNTING ACCESSORIES TO THE FRONT OF A SMALL-BLOCK FORD MOTOR

(75) Inventors: Jack L. Chisenhall, San Antonio, TX (US); Ryan D. Zwicker, New Braunfels, TX (US)

(73) Assignee: Vintage Air, Inc.

( * ) Notice: Subject to any disclaimer, the term of this patent is extended or adjusted under 35 U.S.C. 154(b) by 0 days.

(21) Appl. No.: 11/370,366

(22) Filed: Mar. 8, 2006

(51) Int. Cl.
*F02F 7/00* (2006.01)

(52) U.S. Cl. ..... 123/195 A; 123/198 R

(58) Field of Classification Search ..... 123/195 A, 123/198 R, 195 C, 41.44
See application file for complete search history.

(56) References Cited

U.S. PATENT DOCUMENTS 5,531,648 A * 7/1996 Meckstroth et al. ..... 474/110
5,692,466 A * 12/1997 Hausmann et al. ..... 123/195 A
6,244,239 B1 * 6/2001 Sisco et al. ..... 123/198 R

* cited by examiner

*Primary Examiner*—Stephen K. Cronin
*Assistant Examiner*—Katrina Harris
(74) *Attorney, Agent, or Firm*—Strasburger & Price, LLP

(57) ABSTRACT

A system and method for mounting engine driven accessories to the front of a small block Ford motor includes a bracket which bolts to the front of the cylinder block. Included within the bracket are mountings for a power steering pump, a compressor for an air conditioning system, a water pump, an alternator, and a belt tensioner. Part of the bracket acts as part of the housing for the water pump. Another part of the housing acts as a cover for the timing chain.

6 Claims, 9 Drawing Sheets

BRACKET ASSEMBLY FOR MOUNTING ACCESSORIES TO THE FRONT OF A SMALL-BLOCK FORD MOTOR

FIELD

The present invention relates to mounting accessories to an automotive engine; more particularly the present invention pertains to a system and method for mounting a set of accessories to the front of a popular engine manufactured by the Ford Motor Company—typically referred to as a small block Ford engine or motor.

BACKGROUND

One of the more popular motors used by those who put newer motors into older cars or build cars from the ground-up is the small block Ford motor. The reasons for the selection for the small block Ford motor are many. Specifically, the size of the small block Ford motor permits its use in the small engine compartments of many older cars, particularly older Ford automobiles. Others choose the small block Ford motor because it is easy to work on and both repair and performance parts are inexpensive and readily available. Still others choose the small block Ford motor because of its appearance and the many decorative parts that are available to further enhance its appearance, particularly in automobiles built primarily for show.

Those choosing to use a small block Ford motor often rebuild the motor to include adding: different carburetors or a fuel injection system; high performance ignition systems; and special cylinder heads to provide enhanced flow of intake and exhaust gases. Of these modifications, special cylinder heads provide one of the most popular modifications because of the amount of power that can be added for a limited expense.

When a small block Ford motor is used in an older car, the builders of older cars often desire to update the engine driven accessories by adding accessories available on modern cars that were not available in older cars. For example, most pre-1950's cars did not have power steering systems or air conditioning systems. Older cars also used generators for electrical power while newer cars use alternators.

While individual pulleys and belts were once used to provide rotational power to engine driven accessories, more modern vehicles employ a single belt known as a serpentine belt to provide rotational power to all engine driven accessories. Such serpentine belt systems are both attractive and suitable for use in older cars with smaller engine compartments as they take up less space in front of the engine.

Accordingly, a need remains in the art for a serpentine belt system usable with a small block Ford engine that will permit the addition of a set of modern accessories such as a power steering system pump, an air conditioning system compressor, as well as other necessary accessories such as a water pump and an alternator. Such system should also not interfere with the engine builder's selection of cylinder heads for the small block Ford engine.

SUMMARY

The present invention provides the use of a serpentine belt system with a small block Ford engine to enable the mounting of a power steering pump, an air conditioning system compressor, a water pump and an alternator and will be totally separate from the cylinder heads so that any available cylinder heads may be mounted on the block portion of a small block Ford engine.

The mounting system and method of the present invention includes a bracket which can be bolted to the front of the block portion of a small block Ford engine and does not need to be connected in any way to the cylinder heads. The bracket which enables the mounting system and method of the present invention includes a portion which positions and mounts: a power steering pump; a compressor for an air conditioning system; and an alternator. Also provided is a bracket for mounting a belt tensioner. The top portion of the bracket also provides both a mounting for a water pump and the back portion of the housing for the water pump. The bottom portion of the bracket acts a cover for the timing chain which provides rotational power from the crankshaft to the camshaft on a small block Ford motor.

BRIEF DESCRIPTION OF THE DRAWING FIGURES

A better understanding of the bracket assembly for mounting engine driven accessories to the front of a small block Ford motor may be had from the drawings as explained by the following description of the embodiments, wherein.

DESCRIPTION OF THE EMBODIMENTS

Figure 1:
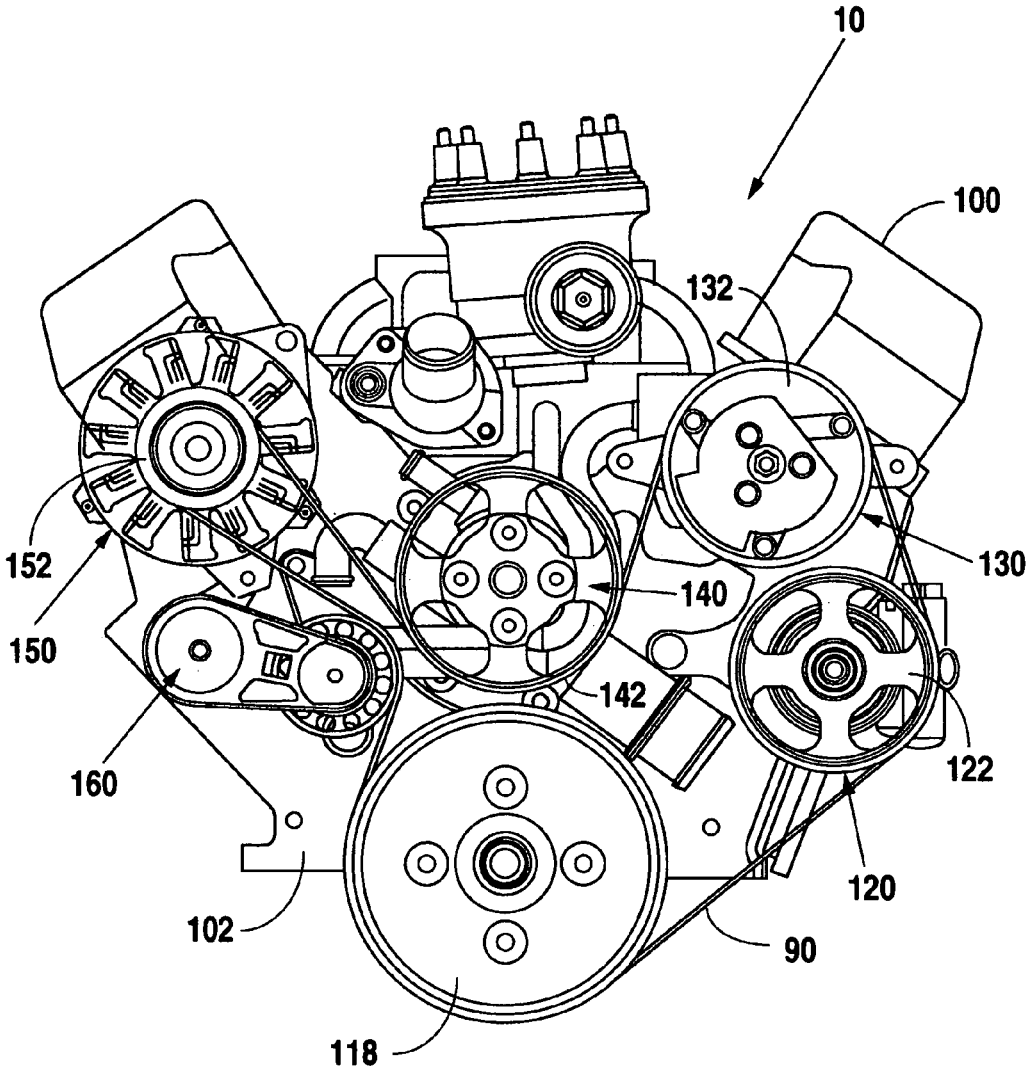
FIG. 1 is a front view of a small block Ford engine including the system and method of the present invention.

The complete installation of the system and method 10 of the present invention to the cylinder block 102 on the front of a small block Ford motor 100 is shown in FIG. 1. Beginning at the bottom of the motor 100 and moving counter-clockwise in the direction of the movement of the serpentine belt 90, those of ordinary skill in the art will recognize first a power steering pump assembly 120. Just above and slightly to the left of the power assembly steering pump 120 is the compressor assembly 130 for the air conditioning system. In the approximate center of the motor 100 is the water assembly pump 140. To the left and slightly above the water pump assembly 140 is the alternator assembly 150. Following the alternator assembly 150 and last in the sequence of the travel of the serpentine belt 90 is the belt tensioner assembly 160 which takes up any slack in the serpentine belt 90 and assures proper frictional contact of the serpentine belt 90 with the drive pulley 118 connected to the crankshaft 106 and the drive pulley 122 positioned on the power steering pump assembly 120, the air conditioning system compressor assembly 180, the drive pulley 142 for the water pump assembly 140 and the drive pulley 152 for the alternator assembly 150. It is the bracket assembly 12 of the present invention which enables positioning and mounting the power steering pump 120, the air conditioning system compressor assembly 130, the water pump assembly 140, and the alternator assembly 150 in the relative positions and in the drive sequence shown.

Figure 2:
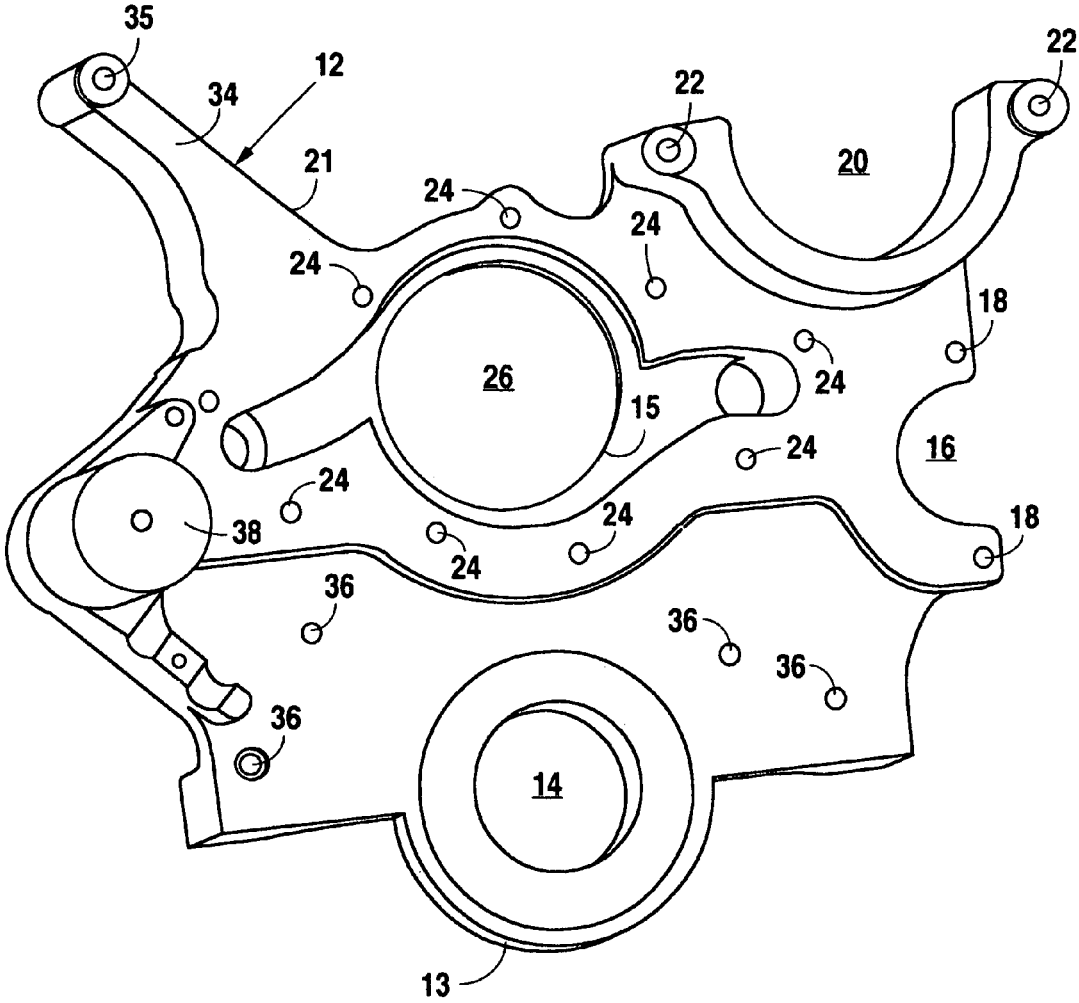
FIG. 2 is a front view of the bracket assembly which bolts to the front of the cylinder block portion of a small block Ford motor.
Figure 3:
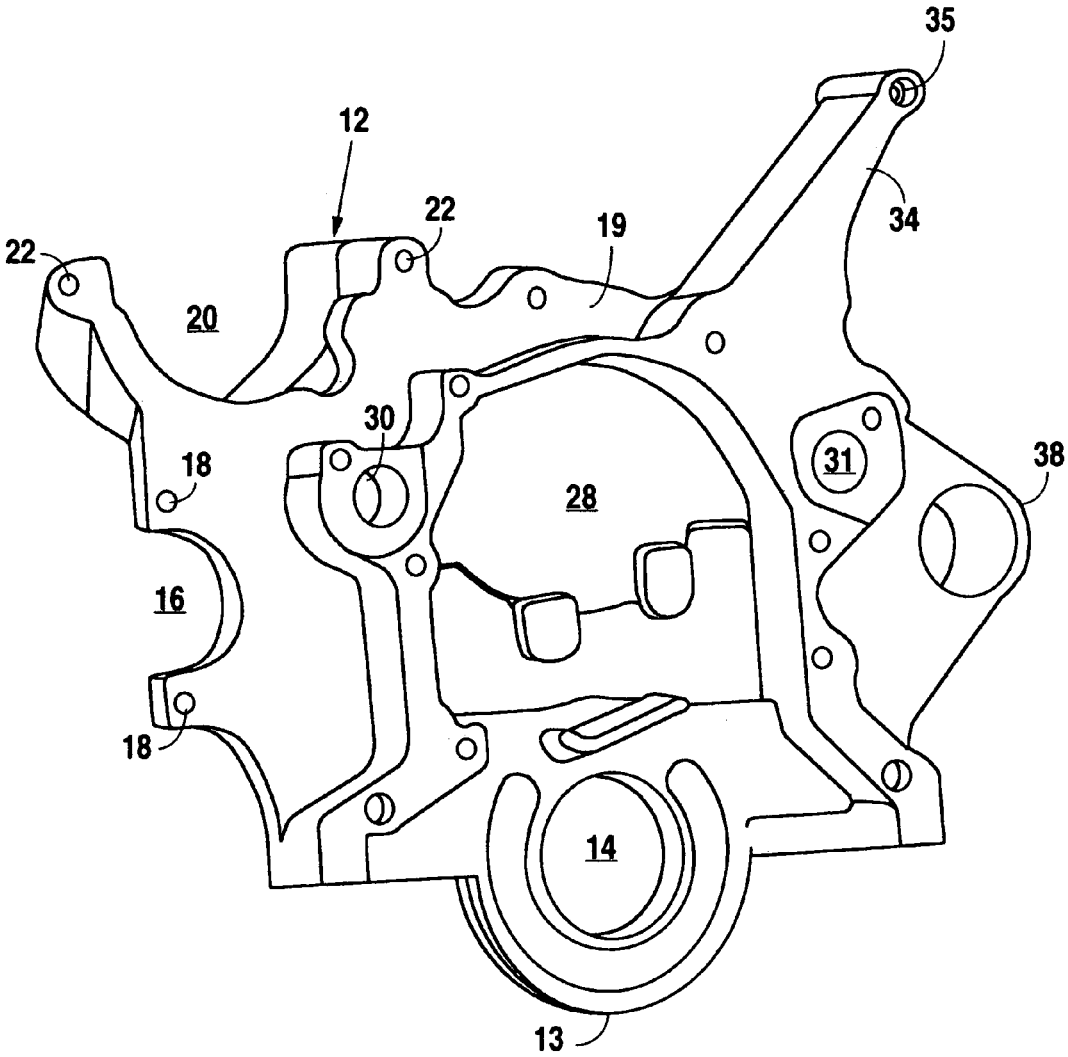
FIG. 3 is a rear perspective of the bracket assembly which bolts to the front of the cylinder block portion of a small block Ford motor.

The one-piece bracket 12 about which the preferred embodiment of the system and method 10 of the present invention is built appears in FIG. 2 and in FIG. 3. At the bottom 13, the circular opening is sized to receive the oil seal (not shown) which is positioned on the front of the crankshaft 106. In the bracket 12 is a circular opening 14 for the front end of the crankshaft 106. The four holes 36 surrounding the circular opening 14 are for the bolts which are used to connect the bracket 12 to the front of the cylinder block 102. Going around the bracket 12 depicted in FIG. 2 in a counter-clockwise manner from the bottom, there is a U-shaped opening 16 and mounting holes 18 to accommodate positioning and mounting of the power steering pump assembly 120. Above the mounting for the power steering pump assembly 120 is another U-shaped opening 20 and set of mounting holes 22 to accommodate the positioning and mounting of the compressor assembly 130 for the air conditioning system.

In the center portion 15 of the bracket 12 are the set of mounting holes 24 for the water pump assembly 140. In the midst of the set of mounting holes 24 for the water pump assembly 140 is a smooth circular finished surface 26. This smooth circular finished surface forms the back part of the housing 146 for the water pump assembly 140. Specifically, the central portion 15 of the bracket 12 not only provides for positioning and mounting for the water pump assembly 140, but it also serves as the back portion of the water pump housing 146.

In the upper left portion 21 of the bracket 12 is arm 34 with a bolt hole 35 at the end. This arm 34 provides for positioning and mounting the alternator assembly 150. Just beneath the mounting for the alternator assembly 150 is the mounting 38 for the belt tensioner assembly 160.

On the back side 19 of the bracket 12 shown in FIG. 3 it may be seen that there is a central opening 28. This opening 28 is sized and positioned to cover the timing chain (not shown) which provides rotational power from the crankshaft 106 to the camshaft (not shown). Also clearly visible from a view of the back side 19 of the bracket 12 are two openings 30, 31 which are sized and positioned to conduct water flowing from the water pump assembly 140 to the water jackets (not shown) within the cylinder block 102.

Figure 4:
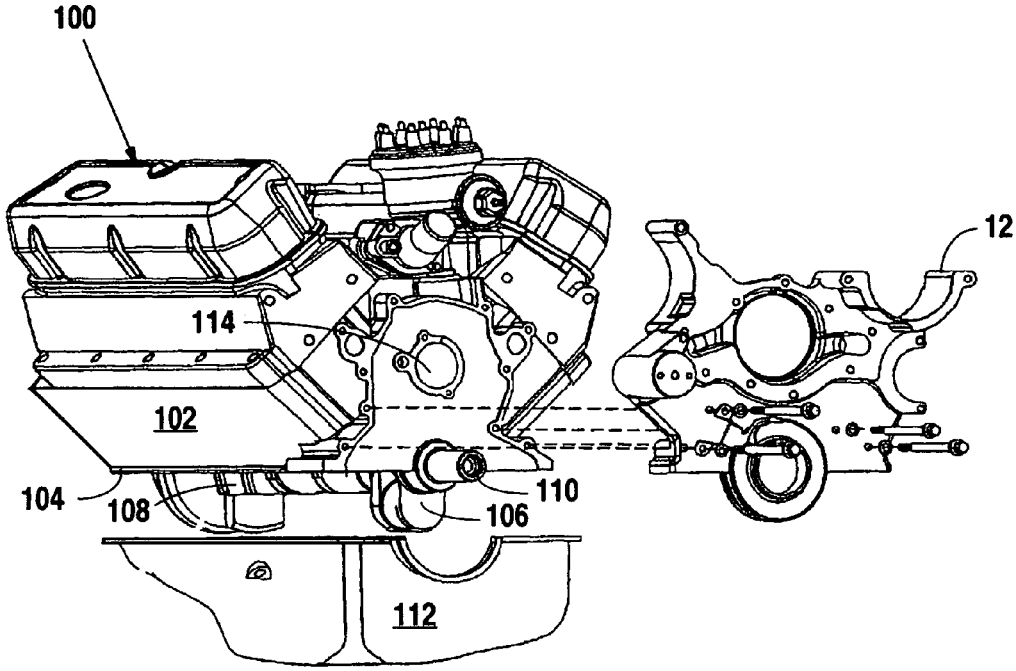
FIG. 4 is an exploded perspective view of the bracket assembly of the present invention with respect to the front of a small block Ford engine.

A still better understanding of the system and method 10 of the present invention may be had by an understanding of its assembly. Shown in FIG. 4 is a small block Ford motor 100. For clarity the oil pan 112 has been dropped down to show the bottom 108 and front 110 of the crankshaft 106. Note that a timing chain (not shown) will be included in the space between the front end 110 of the crankshaft 106 and the end of the camshaft (not shown) which extends through an opening 114 in the middle of the block 102 of the small block Ford motor 100. Positioned and aligned with the cylinder block 102 for the small block Ford motor 100 is the bracket 12 upon which the power steering pump assembly 120, the compressor assembly 130 for the air conditioning system, the water pump assembly 140, the alternator assembly 150, and the belt tensioner assembly 160 will eventually mount. A gasket (not shown) is placed between the bracket 12 and the front of the cylinder block 102.

Figure 5:
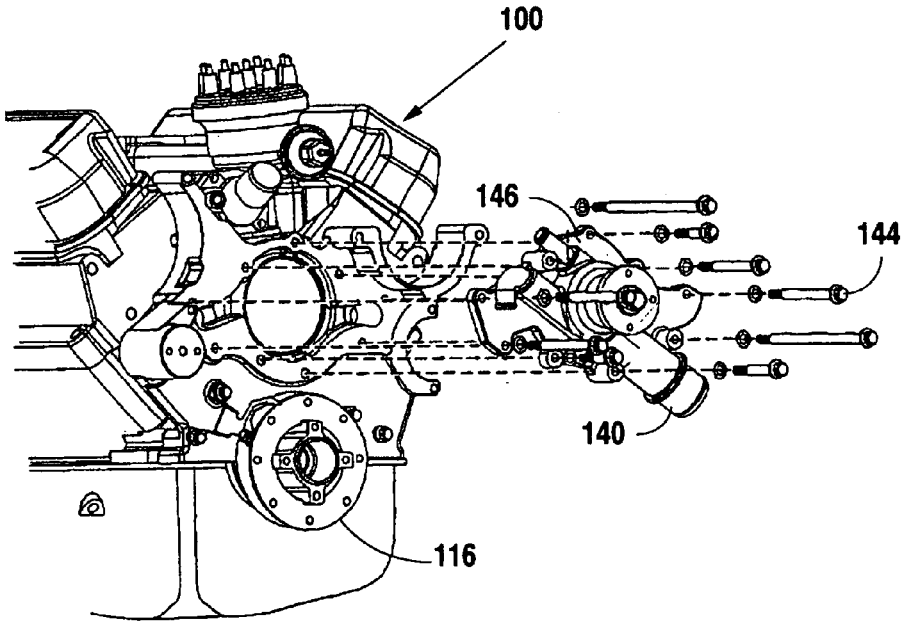
FIG. 5 is an exploded perspective view similar to FIG. 4 showing the positioning and mounting of the front portion of the water pump housing to the bracket assembly of the present invention.

In FIG. 5 the bracket 12 has been bolted to the front of the cylinder block of the small block Ford motor 100. The front 110 of the crankshaft 106 has passed through the opening 14 in the bottom of the bracket 12 and the harmonic balancer 116 has been placed on the end of the crankshaft 106. An oil seal (not shown) is placed around the front end 110 of the crankshaft 106 before the harmonic balancer 116 is mounted thereon. First the water pump assembly 140 is bolted to the bracket 12 using eight bolts 144. The back (not shown) of the water pump assembly 140 is open exposing the impeller (not shown). When the water pump assembly 140 is connected to the bracket 12, the smooth circular finished surface 26 in the center 15 of the bracket 12 and the water pump housing 146 provide the chamber which forms the interior of the water pump assembly 140 in which the impeller for the water pump turns.

Figure 6:
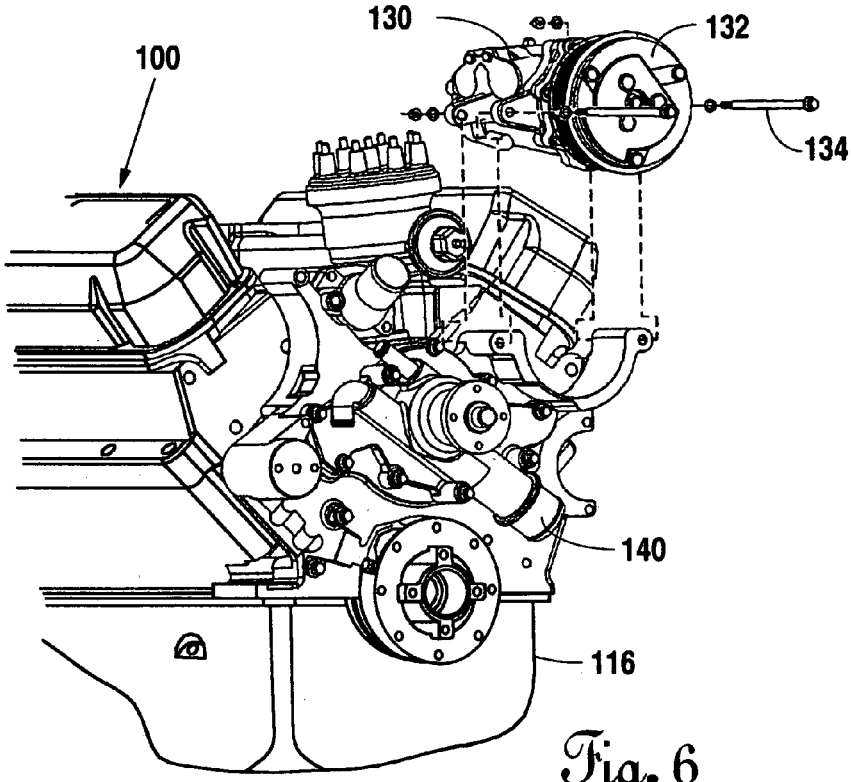
FIG. 6 is an exploded perspective view similar to FIG. 4 showing the positioning and mounting of an air conditioning system compressor.

Once the water pump assembly 140 has been mounted, the compressor assembly 130 for the air conditioning system is positioned and placed into a U-shaped opening 20 in the bracket 12 and attached thereto with two bolts 124 as shown in FIG. 6. At this point in the assembly, the tubing lines 136 which conduct refrigerant to and from the compressor assembly 130 are attached.

Figure 7:
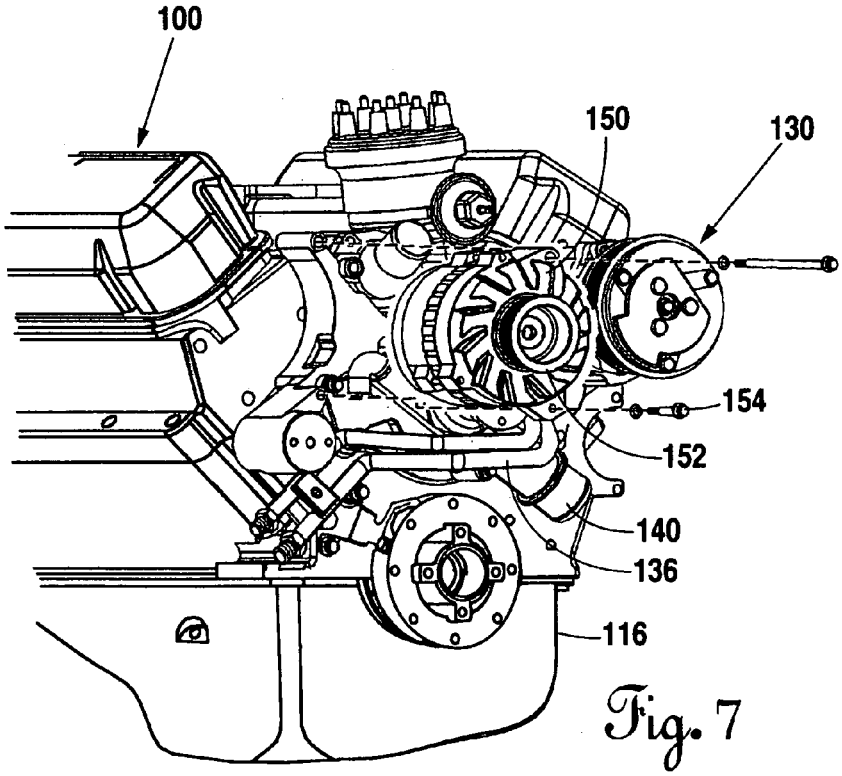
FIG. 7 is an exploded view similar to FIG. 4 showing the positioning and mounting of an alternator.

With the water pump assembly 130 and the compressor assembly 130 for the air conditioning system in place, the alternator assembly 150 is installed as shown in FIG. 7 using two bolts 154.

Figure 8:
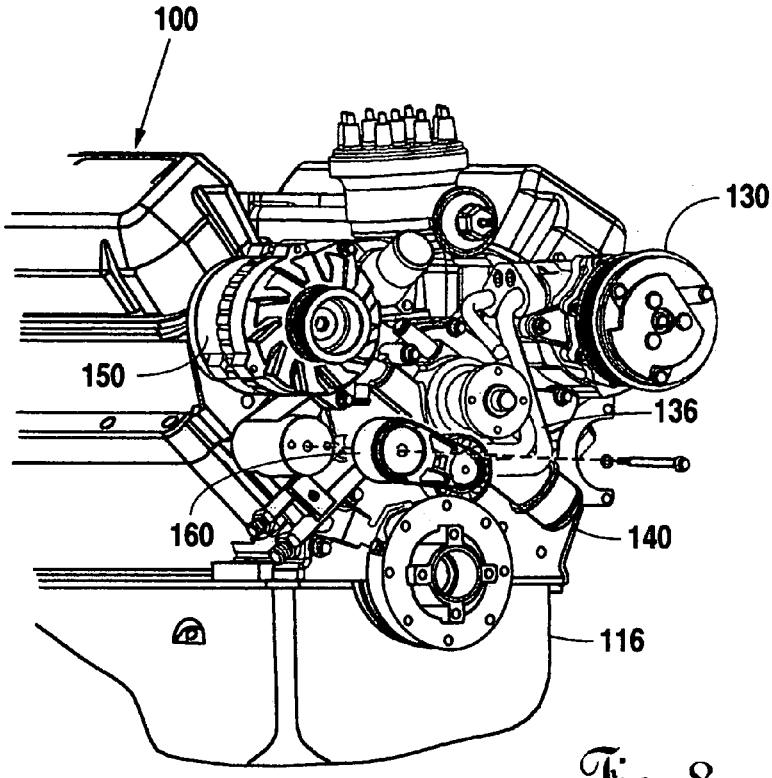
FIG. 8 is an exploded view similar to FIG. 4 showing the positioning and mounting of a serpentine belt tensioner.

Following the installation of the alternator assembly 150, the belt tensioner assembly 160 is attached to the bracket 12 using a single bolt 162 as shown in FIG. 8.

Figure 9:
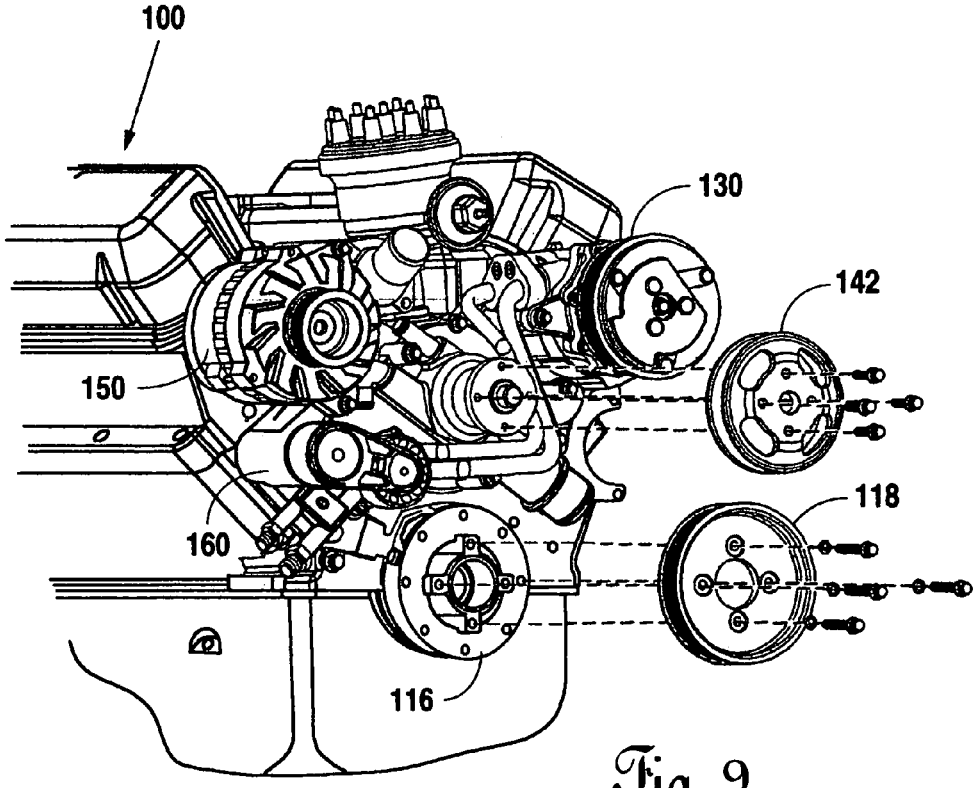
FIG. 9 is an exploded perspective view similar to FIG. 4 showing the installation of a drive pulley on the water pump and the installation of a drive pulley on the harmonic balancer which is affixed to the end of the crankshaft.

As shown in FIG. 9, once all of the individual engine driven accessories, except for the power steering pump assembly 120, have been installed on the bracket 12, the drive pulleys 142 for the water pump assembly 140 and the drive pulley 118 on the harmonic balancer are attached.

Figure 10:
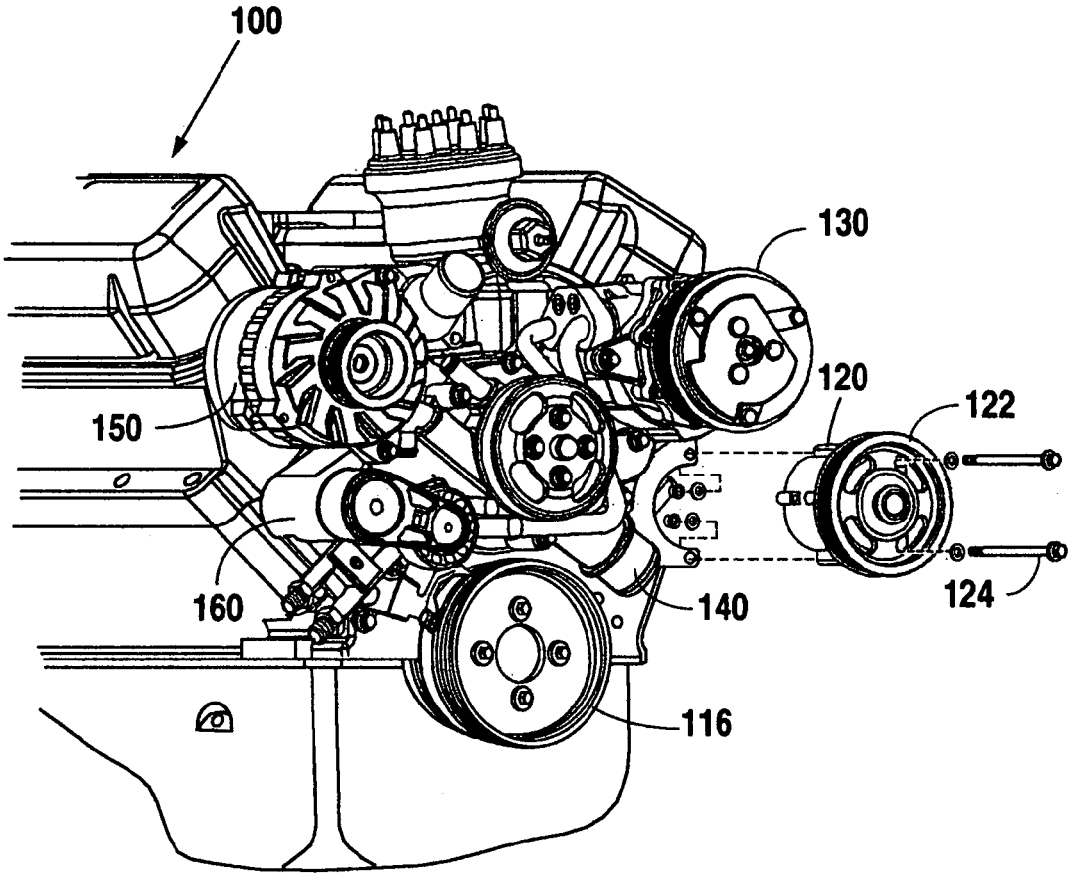
FIG. 10 is an exploded view similar to FIG. 4 showing the positioning and mounting of the power steering pump.

The last accessory to be installed is the power steering pump assembly 120 using two bolts 124 as shown in FIG. 10 which are threadably connected to the bracket 12.

Figure 11:
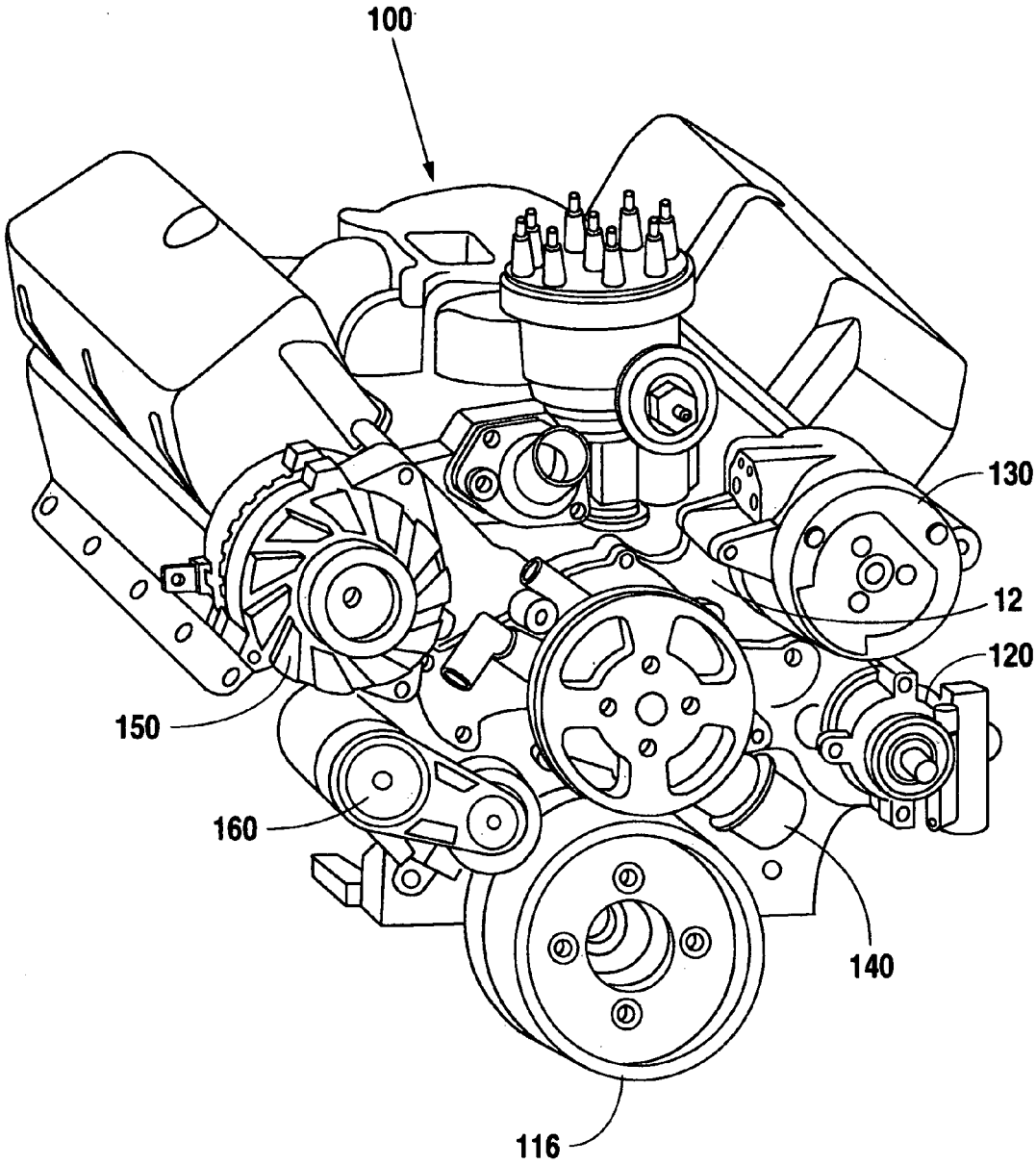
FIG. 11 is a perspective view of a small block Ford engine with the engine bracket assembly of the present invention including the engine driven accessories mounted thereto.

The built up assembly of the engine driven accessories to the front of the cylinder block a small block Ford motor 100 is shown in FIG. 11.

Figure 12:
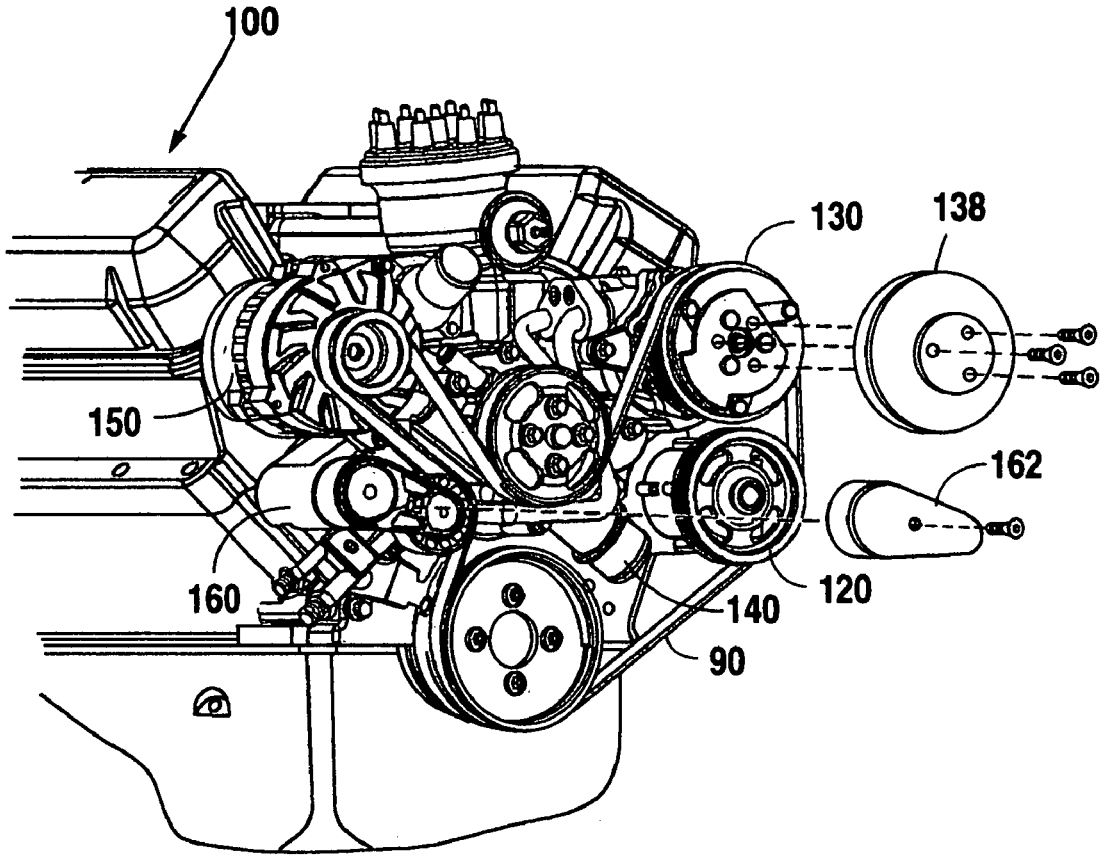
FIG. 12 is a perspective similar to FIG. 4 showing the installation of the serpentine belt and the placement of the compressor cover and the tensioner cover.

The final step is the addition of the serpentine belt 90 as shown in FIG. 12.

As previously indicated the serpentine belt 90 runs in a counter-clockwise direction when viewed from the front of the motor. For maximum belt life, the belt tensioner assembly 160 is positioned as the last item before the serpentine belt 90 engages the crankshaft drive pulley 118.

Those of ordinary skill in the art will also understand that the power steering pump assembly 120, the water pump assembly 140, and the alternator assembly 150 will place a substantially constant rotational load on the serpentine belt 90. However, because the compressor assembly 130 for the air conditioning system includes small pistons, the compressor assembly 130 for the air conditioning system places an intermittent rotational load on the serpentine belt 90. Such intermittent rotational loads often produce unwanted vibrations. To dampen out and thereby reduce the effect of the unwanted vibration from the intermittent rotational load from the compressor for the air conditioning system, the compressor assembly 130 for the air conditioning system is placed between two substantially constant rotational loads; specifically, the power steering pump assembly 120 and the water pump assembly 140. Alternatively, the compressor assembly 130 for the air conditioning system could be placed sequentially along the serpentine belt 90 between the alternator assembly 150 and another accessory providing a substantially constant rotational load.

It may now be seen by those of ordinary skill in the art that the disclosed system and method provides for the mounting of a set of engine driven accessories to the front of a small block Ford motor.

Those of ordinary skill in the art will also understand that the foregoing disclosure will also enable other embodiments of the disclosed invention. Such other embodiments shall be within the scope and meaning of the appended claims.

We claim:

1. A serpentine belt drive system for mounting to the front of the cylinder block portion of a small block motor having a crankshaft pulley extending therefrom, said system comprising:

a water pump mounting, said water pump mounting including a partial housing for the water pump;

a power steering pump mounting;

an air conditioner compressor mounting;

an alternator mounting;

a serpentine belt tensioner mounting;

a timing chain cover;

a bracket integrated with said timing chain cover, said bracket constructed and arranged for mounting to the block portion of the small block Ford motor and for positioning said power steering pump mounting, said air conditioner compressor mounting, said water pump mounting, said alternator mounting, and said serpentine belt tensioner with respect to the crankshaft pulley;

a serpentine drive belt for providing rotational power from the crankshaft pulley first to said power steering pump, then to said air conditioner compressor, then to said water pump, then to said alternator when said power steering mounting, said air conditioner compressor, and said alternator are positioned by said bracket;

said serpentine belt tensioner being positioned between said alternator and the crankshaft pulley.

2. A serpentine belt drive system for providing rotational power to a power steering pump, an air conditioning compressor, a water pump, and an alternator from the crankshaft pulley of a small block engine, said system comprising:

a bracket constructed and arranged for mounting to the front of the cylinder block of a small block Ford motor and for positioning the power steering pump, the air conditioning compressor, the water pump, and the alternator with respect to the water pump and the crankshaft pulley;

a serpentine belt for providing rotational power first to the power steering pump, then to the air conditioning compressor, then to the water pump, then to the alternator;

a serpentine belt tensioner positioned between the alternator and the crankshaft pulley.

3. An accessory drive system for mounting to the front of the cylinder block of a small block motor, said system comprising:

a serpentine belt for receiving rotational power from a pulley attached to the end of the crankshaft extending from the block of the small block Ford motor;

said serpentine belt constructed and arranged to provide rotational power from the pulley on the end of the crankshaft to the following accessories in the order and sequence listed below:

a first engine driven accessory having a substantially consistent rotational load;

an air conditioning compressor having an intermittent rotational load;

a second engine driven accessory having a substantially consistent rotational load;

a belt tensioner positioned between said second accessory and the pulley on the end of the crankshaft;

wherein the vibration from said intermittent rotational load of said air conditioning compressor are damped by being located between said first engine driven accessory having a substantially consistent rotational load and said second engine driven accessory having a substantially consistent rotational load.

4. The system as defined in claim 3 wherein said first engine driven accessory is selected from a group of engine driven accessories having a substantially consistent rotational load including: a power steering pump, a water pump, and an alternator.

5. The system as defined in claim 3 wherein said second engine driven accessory is selected from a group of engine driven accessories having a substantially consistent rotational load including a power steering pump, a water pump, and an alternator.

6. A method for mounting an accessory package to the front of the cylinder block of a small block motor, said method comprising the steps of:

attaching a bracket including the mounting for a power steering pump, an air conditioning compressor, a water pump, an alternator, and a belt tensioner to the block of the small block Ford motor;

mounting a power steering pump, an air conditioning compressor, a water pump, an alternator, and a belt tensioner to said bracket;

engaging first said power steering pump, then said air conditioning compressor, the water pump, the said alternator, then said belt tensioner with a serpentine belt.

* * * * *